US005914155A

United States Patent [19]

Kurtz

[11] Patent Number: 5,914,155

[45] Date of Patent: Jun. 22, 1999

[54] METHOD AND APPLICATOR FOR DIRECT OR INDIRECT APPLICATION OF A LIQUID OR PASTY COATING MEDIUM ONTO A TRAVELING MATERIAL WEB, NOTABLY OF PAPER OR CARDBOARD

[75] Inventor: Rüdiger Kurtz, Heidenheim, Germany

[73] Assignee: Voith Sulzer Papiermaschinen GmbH, Heidenheim, Germany

[21] Appl. No.: 08/991,910

[22] Filed: Dec. 16, 1997

[30] Foreign Application Priority Data

Dec. 18, 1996 [DE] Germany ..... 196 52 827

[51] Int. Cl.[6] ..... B05B 5/00; B05B 1/26; B05D 1/02

[52] U.S. Cl. ..... 427/424; 118/325; 239/124; 239/521

[58] Field of Search ..... 118/325, 324, 118/410, 413, 419; 427/420, 421, 424; 239/124, 461, 521

[56] References Cited

U.S. PATENT DOCUMENTS

| | | | |
|---|---|---|---|
| 4,095,444 | 6/1978 | Pascoe, Sr. et al. | 68/205 |
| 4,202,188 | 5/1980 | Gruber | 118/325 |
| 4,834,018 | 5/1989 | Sollinger et al. | 118/410 |
| 4,880,671 | 11/1989 | Sollinger et al. | 427/356 |
| 4,921,650 | 5/1990 | Eriksson et al. | 264/37 |
| 5,192,591 | 3/1993 | Chance | 118/410 |
| 5,282,377 | 2/1994 | Illig et al. | 118/325 |
| 5,350,597 | 9/1994 | Pelley | 427/197 |
| 5,588,998 | 12/1996 | Koskinen | 118/410 |

FOREIGN PATENT DOCUMENTS

| | | | |
|---|---|---|---|
| 37 38 658 A1 | 5/1988 | Germany | B05C 5/02 |
| 43 36 365 A1 | 4/1994 | Germany | B05C 11/04 |
| 295 20 678U1 | 7/1996 | Germany | B05C 5/02 |

*Primary Examiner*—David A. Simmons
*Attorney, Agent, or Firm*—Taylor & Associates, P. C.

[57] ABSTRACT

An applicator for direct or indirect application of a liquid or pasty coating medium onto a traveling material web, notably of paper or cardboard, includes at least one open-jet nozzle from which the coating medium issues in an open jet extending through the ambient atmosphere. The applicator also includes at least one traveling countersurface disposed opposite the open-jet nozzle and to be acted upon by the open jet. At least one jet-splitting system is arranged in the open jet in an area contained between the exit of the open-jet nozzle and the countersurface. The jet-splitting system divides the open jet into at least one diversion jet and at least one coating jet which flows on the countersurface.

15 Claims, 3 Drawing Sheets

METHOD AND APPLICATOR FOR DIRECT OR INDIRECT APPLICATION OF A LIQUID OR PASTY COATING MEDIUM ONTO A TRAVELING MATERIAL WEB, NOTABLY OF PAPER OR CARDBOARD

BACKGROUND OF THE INVENTION

1. Field of the Invention

The present invention relates to a method and applicator for direct or indirect application of a liquid or pasty coating medium onto a traveling material web, notably of paper or cardboard.

2. Description of the Related Art

Applicators are used in so-called coating systems for providing a traveling material web, formed for example of paper, cardboard or a textile material, on one or both sides with one or several layers of the coating medium, for example color, starch, impregnating fluid or the like.

In the so-called direct application, the liquid or pasty coating medium is applied by an applicator system directly onto the surface of the traveling fiber material web. The web is carried during application on a rotating countersurface, for example an endless belt or a backing roll. In the indirect application of the medium, the liquid or pasty coating medium is first applied onto a substrate, for example the surface of a backing roll configured as an applicator roll. The coating medium is then transferred from the applicator roll to the material web, in a nip through which the material web passes.

Known from German Patent Document No. DE 43 36 365 A1 is an applicator for direct application of a liquid or pasty coating medium onto a traveling material web, notably of paper or cardboard. The applicator includes a metering slot configured as an open-jet nozzle and from which issues the coating medium in an open jet extending through the ambient atmosphere. The applicator also includes a countersurface disposed opposite the open-jet nozzle, in the form of the material web supported by a backing roll and acted upon by the open jet. To avoid quality impairments occurring notably at high speeds of the material web due to air entrained in the coating layer, the open jet is directed, according to DE 43 36 365 A1, in a direction opposite to the direction of travel of the material web. Upon impinging on the material web, the open jet splits into a backflow, proceeding in a direction opposite to the direction of travel of the material web, and a mixed flow of coating substance proceeding in the direction of travel of the material web. The portion of backflow achievable of the overall flow of the open jet amounts to about 30 to 60 percent. The applied coating medium is subsequently profiled by a doctor element following the open-jet nozzle. Owing to the above measures, a good penetration of the coating medium into the material web is accomplished pursuant to DE 43 36 365 A1. Further, an entrainment of air in the coating medium, and thus the occurrence of undesirable air bubbles, is avoided.

In conventional applicators of the type described above it has been found that the width of the metering slot forming the open-jet nozzle cannot be configured selectively small without entailing an untidy or disuniform open jet or clogging of the nozzle. This leads to a poor coating result and high maintenance expense. This has been found to be true particularly for the production of low coating weights, that is, small coating quantities or a thin coating. Therefore, with conventional applicators, a larger amount of liquid or pasty coating medium, larger than would be necessary for the desired coating with a low coating weight, must first be applied at surplus to produce a neat coating. The coating medium must thereafter be scraped down again. This, in turn, involves a higher energy demand and a larger size of the applicator and, moreover, requires more expensive accessory systems.

The present invention provides an improved applicator such that the disadvantages associated with the prior art are avoided to the greatest possible extent. Also, the production of a high quality coating with a low coating weight can be easily realized.

SUMMARY OF THE INVENTION

This applicator for direct or indirect application of a liquid or pasty coating medium onto a traveling material web, notably of paper or cardboard, includes at least one open-jet nozzle from which issues the coating medium in an open jet extending through the ambient atmosphere. The applicator also includes at least one traveling countersurface disposed opposite the open-jet nozzle and to be acted upon by the open jet. At least one jet-splitting system is provided that is arranged in the open jet, in an area between the exit of the open-jet nozzle and the countersurface. The jet-splitting system divides the open jet into at least one diversion jet and at least one coating jet flowing onto the countersurface. The diversion jet is suitably returned to a pumping circuit and recycled. It is also possible to arrange several jet-splitting systems in series. The open-jet nozzle of the inventional applicator is a metering slot formed between two lips, the slot width being adjustable. Moreover, the open-jet nozzle may be equipped with at least one guide or deflection surface following the metering slot exit. The open-jet nozzle or parts thereof may be configured, for adjustment of the angle of impingement of the open jet on the jet-splitting surface, to uniformly rotate or pivot substantially across the entire machine width and/or zonewise. It is also possible to provide before an approach-side section of the jet-splitting system a device for warding off the boundary air layer entrained by the backing roll or the material web. The device avoids the occurrence of negative boundary layer phenomena and thus contributes to a further improvement of the coating quality.

Owing to its jet-splitting system, the inventional applicator allows in an easy and effective way the production of a high quality, thinner coating, or lower coating weight, than would be achievable with production engineering measures based solely on presetting or adjustment of the nozzle opening width. To avoid nozzle clogging, larger nozzle opening widths can thus be employed while nevertheless achieving very slight thicknesses of the coating jet. Also possible is a finish-metering to low coating weights, making laborious and expensive accessory systems avoidable. Moreover, the jet-splitting system offers in comparison to conventional applicators a further option for adjustment and manipulation of the coating weight. Depending on the configuration of the jet splitting system, the portion of the coating jet of the overall flow of the open jet is selectable from 0 to 100 percent, enabling a very broad spectrum of adjustment. As needed, the jet-splitting system may also be adjusted such that no diversion jet occurs. Thus, the open jet is not split and flows strictly as coating jet onto the countersurface, a deflection of the open jet being optional. The inventional applicator, moreover, allows a distinct reduction of the amount of coating that needs to be applied onto the counter-surface for a high quality coating. This, in turn, enables a reduction of the necessary energy demand and size both of individual components of the applicator, such as pumps, collection containers etc., and also of the entire applicator. Thus manufacturing, operating and maintenance costs are lowered.

According to one configuration feature of the invention, the jet-splitting system of the applicator includes at least one jet-splitting surface on which the open jet impinges at a predetermined impingement angle $\alpha$. The coating jet departs at an angle $\beta$ from the jet-splitting surface, while the diversion jet departs at an angle $\gamma$. The geometry of the jet-splitting surface is adapted to the desired jet-splitting properties as well as the flow properties of the coating medium. For example, the jet-splitting surface may cross-sectionally have a symmetric or asymmetric shape and, in addition, may also include special jet-splitting elements, such as cuneiform, blade-like, knife-like or tear-edge-like sections protruding in the open jet. The jet-splitting surface and the angles $\alpha$, $\beta$ and $\gamma$ thus allow a defined division and manipulation of the coating medium ejected out of the nozzle opening. The angles $\alpha$, $\beta$ and $\gamma$ depend on the shape and arrangement of the jet-splitting surface and may be equal or different, depending on the selection of the reference surfaces or references planes by which the angles are measured. The angle of flow $\beta$ of the coating jet also determines the angle of impingement $\phi$ onto the countersurface to be acted upon.

Embodiments in which the jet-splitting surface, viewed in cross section, is straight, convex, concave or double-concave have led to particular jet-splitting and manipulating properties. However, the invention is not limited to these specific forms. Any other suitable forms may be used as well.

The geometry of the jet-splitting surface can be adjustable, allowing an adaptation of the shape of the jet-splitting surface to altered or changing operating conditions both in standstill and in the operation of the applicator. The position of the jet-splitting surface relative to the open-jet nozzle and/or to the countersurface may be kept constant or, as illustrated in detail hereinafter, may be varied.

According to a further embodiment of the invention, the jet-splitting surface is provided with a predetermined surface structure and/or surface coating. Depending on application, the surface of the jet-splitting surface may be hydraulically smooth roughened, or equipped with a special surface structure, for example, with a knurled or wavy surface that may serve to produce a specific shear rate in the coating medium flowing along the jet-splitting surface. Consequently, it is also possible to provide the jet-splitting surface with a wear-resistant coating, for example, an oxide ceramic layer, for wear reduction.

In a further configuration variant of the inventional applicator, the jet-splitting surface is arranged so as to be movable relative to the open-jet nozzle and/or relative to the countersurface to be coated. The mobility of the jet-splitting surface allows an exact adjustment of the splitting conditions, the volume or mass flows of diversion jet and coating jet, or the previously addressed variation of the angle of impingement of the coating jet. The mobility of the jet-splitting surface also allows an adaptation of an individual jet-splitting system to altered or changing operating conditions, such as the selection of a different coating medium and the like. The applicational options of the jet-splitting system are thereby extended considerably.

In this context it is also possible to arrange the jet-splitting surface, based on the direction of the open jet, so as to be rotatable or pivotable and/or allow translatory movement uniformly across substantially the entire machine width. These adjustment options are especially easy to realize in terms of engineering. Further, these adjustment options create, with the selected geometry of the jet-splitting surface, specific desired jet-splitting properties. If needed, the jet-splitting surface may be arranged, based on the direction of the open jet, so as to be zonewise rotatable or pivotable and/or to allow zonewise translatory movement. The jet-splitting surface is for that purpose subdivided in zone fashion or to allow appropriate elastic deformation across zone-like sections. A zonewise different adjustment of the jet-splitting surface is suited primarily for compensation of local manufacturing tolerances as well as for producing and manipulating a desired cross profile of the coating medium applied or to be applied.

The invention is not limited to the types of movable arrangements of the jet-splitting surface described above. It is also possible to arrange the jet-splitting system, and with it the jet-splitting surface, so as to be movable in a direction intersecting the direction of the open jet, for alteration and/or adjustment of the volume or mass flow of the coating jet and/or the diversion jet.

To adjust the jet-splitting surface in the way described above, the inventional applicator is equipped with at least one adjustment system.

The inventional applicator includes at least one control system with a feedback control which incorporates the aforementioned adjustment system. This allows, specifically in the operation of the applicator, a quick and reliable adaptation of the respective jet-splitting surface position to changing operating conditions.

Lastly, another configuration feature of the inventional applicator provides for the jet-splitting system to include at least one heating system and/or at least one cooling system. In this way, the jet-splitting system may be heated and/or cooled as needed, in order to influence, e.g., the viscosity and/or immobilization point of the coating medium making contact with the jet-splitting system.

The inventional method for direct or indirect application of a liquid or pasty coating medium onto a traveling material web, notably of paper or cardboard, has the advantages already discussed in conjunction with the inventional applicator.

According to a configuration feature of the inventional method, the angle of impingement of the open jet on the jet-splitting system is changed for variation and/or adjustment of the volume flow or mass flow of the coating jet and/or of the diversion jet, and/or for adjustment or change of the angle of impingement of the coating jet on the countersurface. This angular variation can be carried out both by appropriate movement of the jet-splitting system itself and by moving the open-jet nozzle or parts of it relative to the jet-splitting system. Moreover, this angular adjustment may take place uniformly across substantially the entire machine width or, when needed, zonewise differently.

The inventional method is supplemented by a step in which the coating medium portion forming the diversion jet is collected and returned to a coating medium circulation. Appropriate collection systems as well as lines and pumping and filter systems are provided for that purpose. This enables the reuse of the diverted coating medium portion. Due to the distinct reduction of the coating quantity that is possible with the inventional coating method, the aforementioned applicator components necessary for coating medium circulation can be considerably reduced in size.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
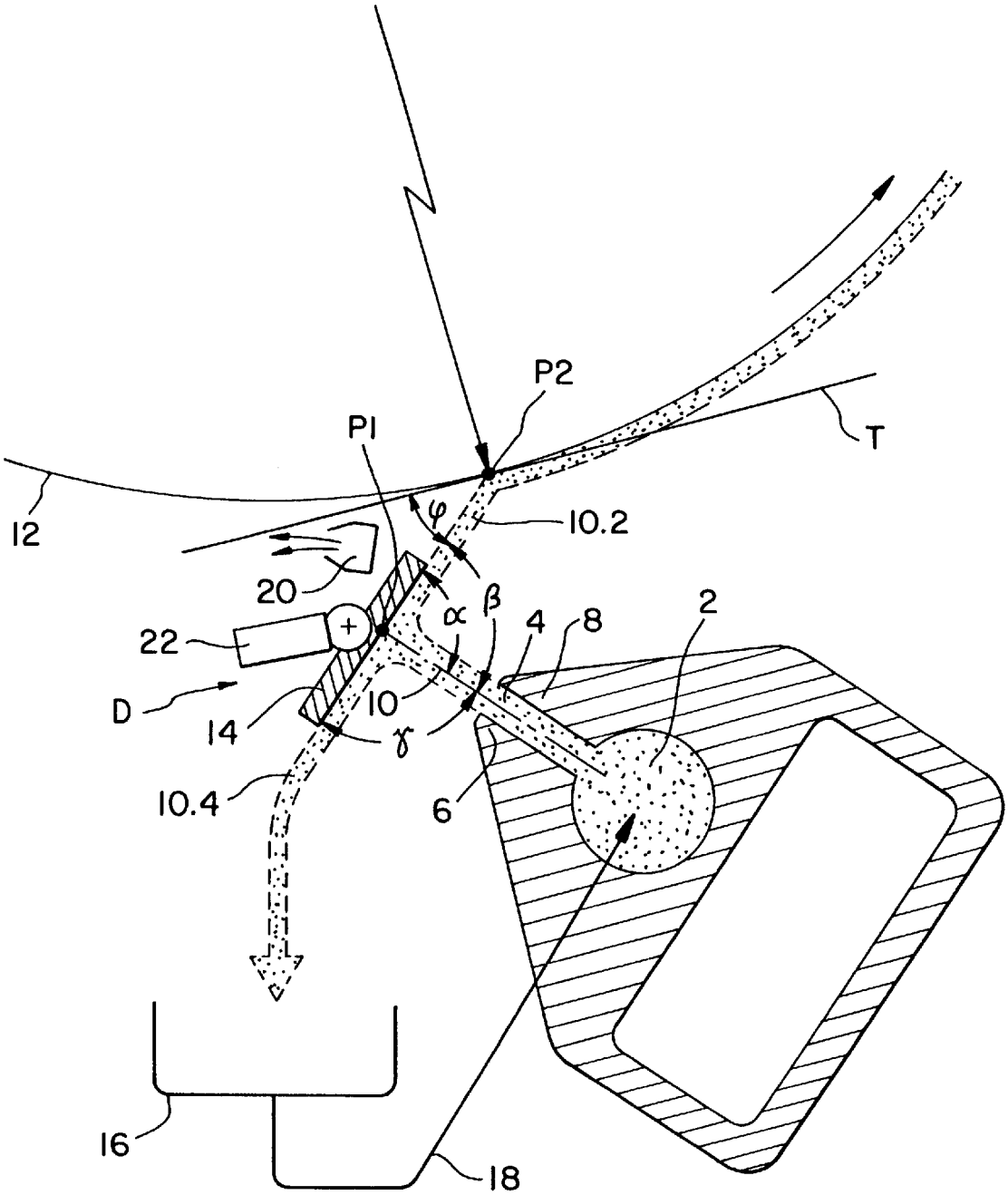
FIG. 1 is a schematic cross-sectional illustration of a first embodiment of the inventional applicator in the area of a metering system equipped with an open-jet nozzle and a jet-splitting system.

FIG. 1 illustrates one embodiment of the inventional applicator, configured as an applicator for indirect application of a liquid or pasty coating medium 2 onto a traveling material web, notably of paper or cardboard, including a metering system with a metering slot 4 configured as an open-jet nozzle and formed between two lips 6, 8. Known as such, a metering system of this type is being marketed, e.g., by the assignee of the present invention under the trade name "Jet-Flow-F." The metering slot 4 from which coating medium 2 issues in an open jet 10 extending through the ambient atmosphere is opposed by a countersurface 12, which can be either a fiber material web in the case of direct application or an applicator roll in the case of indirect application, serving as a substrate surface to be acted upon by open jet 10. The direction of rotation of roll 12 is indicated by an arrow. In a not illustrated nip through which the fiber material web passes, coating medium 2 is transferred from applicator roll 12 to the fiber material web. Of the two lips 6, 8 forming metering slot 4, the one disposed on the side of metering slot 4 which applicator roll 12 approaches is called the approach-side lip 6. Accordingly, the second lip 8, disposed on the side of metering slot 4 from which applicator roll 12 departs, is described as the departure-side lip 8.

A jet-splitting system D disposed in open jet 10 is provided in an area between the exit of metering slot 4 of the open-jet nozzle and applicator roll 12. Jet-splitting system D divides open jet 10 into a diversion jet 10.4 and a coating jet 10.2 flowing onto applicator roll 12. In the present embodiment, jet-splitting system D is configured in the way of an adjustably arranged baffle with a substantially flat jet-splitting surface 14. Open jet 10 issues out of metering slot 4 and impinges on jet-splitting surface 14 at an impingement angle $\alpha$. Coating jet 10.2 flows to the right and up from jet-splitting surface 14 at an angle $\beta$. Diversion jet 10.4 flows to the left and down at an angle $\gamma$. The angle of impingement $\alpha$ is measured between a tangent to the jet-splitting surface 14 at the point of impingement P1 of open jet 10 and the center thread of flow of open jet 10. The angles $\beta$ and $\gamma$ are measured between the center thread of flow of open jet 10 and the center thread of flow of coating jet 10.2 and diversion jet 10.4, respectively, leaving jet-splitting surface 14. The departure angle $\beta$ of coating jet 10.2 determines the angle of impingement $\phi$ of coating jet 10.2 on applicator roll 12. Angle $\phi$ is measured at the point of impinge-ment P2 of coating jet 10.2, between a tangent T to applicator roll 12 and the center thread of flow of coating jet 10.2. In this configuration, coating jet 10.2 impinges on applicator roll 12 in its direction of rotation. The coating is carried out finish-metered, without surplus; that is, a doctor element following the location of application is not required with this variant.

Thus, jet-splitting surface 14 divides the overall flow (volume flow or mass flow) of the open jet 10 issuing out of the metering slot 4 into two partial flows, namely coating jet 10.2 and diversion jet 10.4 which, depending on the adjustment of the jet-splitting surface 14, are each smaller than or equal to the overall flow. The percentage of the overall flow of open jet 10 that forms coating jet 10.2 is adjustable, generally from 0 to 100 percent, as will be explained hereinafter in detail.

The coating medium portion forming diversion jet 10.4 is gathered in a collection system 16 and returned to the coating medium circulation, which enables a reuse of the diverted coating medium portion. The lines and pumping and filtering systems pertaining to collection system 16 are referenced 18 collectively in the drawing.

Near an approach-side section of jet-splitting system D, a system 20 is provided for warding off the boundary air layer entrained by applicator roll 12. Blowing system 20 extends substantially across the entire width of the applicator roll and generates by air blowout a "boundary layer curtain" in a direction opposite to the direction of rotation of applicator roll 12. System 20 avoids the influence of boundary layer phenomena which have a negative effect on the coating quality.

Figure 2A:
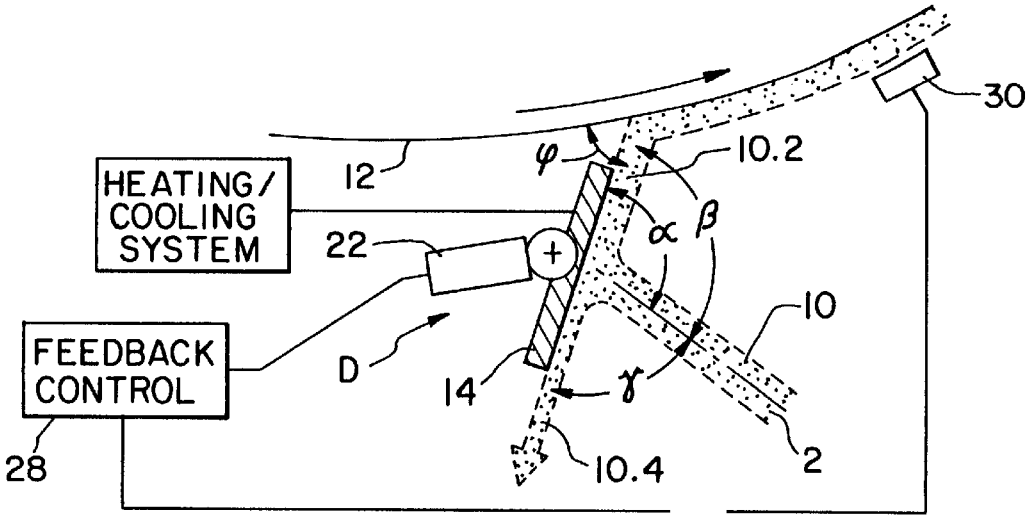
FIG. 2*a* is a schematic cross-sectional illustration of the jet-splitting system of FIG. 1 in a first position of adjustment.
Figure 2B:
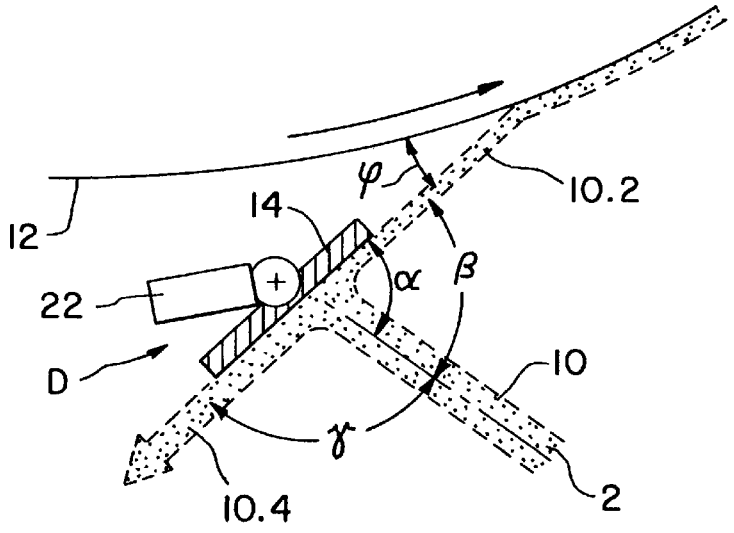
FIG. 2*b* is a schematic cross-sectional illustration of the jet-splitting system of FIG. 1 in a second position of adjustment.

FIG. 2*a* is a schematic cross-sectional illustration of the jet-splitting system D of FIG. 1 in a first position of adjustment, while FIG. 2*b* shows a second position of adjustment. The metering system as well as the collection system 16 and the systems 18 and 20 are not shown, for the sake of simplicity. As can be seen in these two figures, the jet-splitting surface 14 of jet-splitting system D is movable relative to both applicator roll 12 and the metering slot of the open-jet nozzle. Thus, jet-splitting surface 14 is also movable relative to the direction of the open jet 10 issuing out of the metering slot. Further, jet-splitting surface 14 is rotatable both uniformly substantially across the entire machine width and also, if needed, zonewise differently. The zonewise adjustability is enabled by jet-splitting surface 14 being torsionally elastic. To adjust the jet-splitting surface 14, an adjustment system is provided which includes a plurality of actuators 22. Actuators 22 act directly or indirectly on jet-splitting surface 14 and are spaced uniformly or varyingly from one another in the width direction of jet-splitting system D, and thus in the width direction of the machine. This adjustment system is incorporated in a feedback control 28 of a control system including at least one sensor 30. Feedback control 28 achieves a desired cross profile and/or length profile by continually adjusting the setting of jet-splitting surface 14 depending on different measured values, such as the actual cross profile and/or length profile of the produced coating.

Adjustment of the impingement angle a of open jet 10 on jet-splitting surface 14 is effected by rotation of the jet-splitting surface 14 as indicated in FIGS. 2*a* and 2*b*. The rotation allows a change or adjustment of the volume flow or mass flow of coating jet 10.2 and diversion jet 10.4. Thus, the portion of the coating jet 10.2 of the entire flow of the open jet 10 can be selected within an adjustment range from 0 to 100 percent, depending on rotation. With the illustrated configuration of the jet-splitting surface 14, changing the angle α (corresponding here, with the selected reference lines or reference planes, to the angle β) occasions at the same time a change of the departure angles β, γ and impingement angle φ of coating jet 10.2 on the surface of applicator roll 12. However, a variation of the angles β, γ and φ does not mandatorily result from changing impingement angle α, since that depends primarily on the respective configurations of jet-splitting surface 14 and its adjustment options. Namely, as already initially indicated, with the geometry of jet-splitting surface 14 itself configured to be adjustable, constant angles β, γ, φ can very well be realized with a variable impingement angle α. Similarly, it is possible to influence the portion of coating jet 10.2 of the overall flow by suitable variation of at least one of the angles β and γ.

As indicated in FIG. 2*a*, enlargement of the angle α increases the volume flow or mass flow of coating jet 10.2 and reduces that of diversion jet 10.4, thereby obtaining a heavier coating. In FIG. 2*b*, in contrast, the volume flow or mass flow of the coating jet 10.2 is reduced by a reduction of the angle α and the volume flow or mass flow of the diversion jet 10.4 is increased, thus producing a thinner coating.

Figure 3:
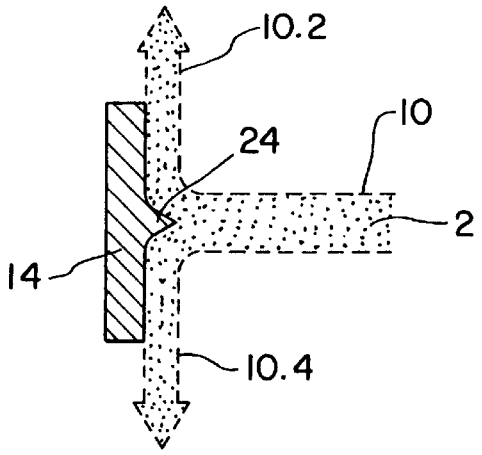
FIG. 3 is a schematic cross-sectional illustration of a jet-splitting surface of a jet-splitting system according to a second embodiment.

FIG. 3 shows a schematic cross-sectional illustration of a jet-splitting surface 14 of a jet-splitting system according to a second embodiment. Jet-splitting surface 14 corresponds essentially to the variant shown in FIGS. 1, 2*a* and 2*b*. However, it additionally possesses an integrally molded cuneiform jet-splitting element 24 in the center of its side coordinated with the open jet 10. The point of element 24 is directed into the open jet 10 impinging on the jet-splitting surface 14, thus more easily and effectively dividing the open jet 10 into the coating jet 10.2 and the diversion jet 10.4.

Figure 4:
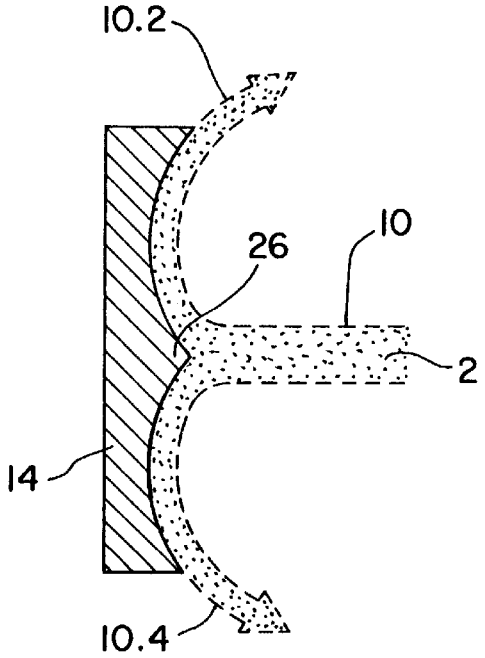
FIG. 4 is a schematic cross-sectional illustration of a jet-splitting surface of a jet-splitting system according to a third embodiment.

FIG. 4 shows a schematic cross-sectional illustration of a jet-splitting surface 14 of a jet-splitting system according to a third embodiment. Relative to the impinging open jet 10, the jet-splitting surface 14 has a double-concave cross-sectional shape. The cuneiform transition 26 between the two individual concave sections of this surface forms a jet-splitting element such as already illustrated in conjunction with FIG. 3.

The invention is not limited to the above exemplary embodiments, which merely serve the general explanation of the basic idea of the invention. Rather, the inventional applicator may, within the scope of protection, also assume configurations other than described above. Specifically, the applicator may possess features representing a combination of the respective individual features. Contrary to the arrangement of the open-jet nozzle and the jet-splitting system as described in the embodiments, it is also possible to position these components in relation to the backing roll to be coated such that the coating jet diverted by the jet-splitting surface is directed opposite to the direction of rotation of the backing roll. Instead of the metering system illustrated above, other suitable open-jet nozzle applicator or metering systems are also usable, such as systems featuring, e.g., a concave or convex deflection surface or a straight guide surface. Contrary to the variant illustrated above, the application also may take place at surplus, if needed. That is, part of the coating medium applied by the coating jet is removed by a doctor element, e.g., a doctor blade, a roll doctor or the like, or scraped down to a desired cross profile and/or length profile, and thus finish-metered. It is also possible to adjust the jet-splitting surface by turning, pivoting or tilting it (e.g., at an angle β slightly larger than 90°) such that no splitting of the open jet takes place, no diversion jet occurs and the open jet flows on the countersurface at full rate, directly or deflected.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An applicator for application of a coating medium onto a traveling fiber material web having a width, said applicator comprising:

at least one open-jet nozzle including an exit configured for issuing an open jet of the coating medium into the ambient atmosphere;

at least one countersurface disposed opposite said open-jet nozzle, at least one said countersurface being configured for one of backing the fiber web while the fiber web receives the coating medium from said at least one open-jet nozzle and transferring the coating medium from said at least one open-jet nozzle to the fiber web; and at least one jet-splitting system disposed between said exit of said one open-jet nozzle and said at least one countersurface, said at least one jet-splitting system being configured to be positioned in said open jet of the coating medium from said one open-jet nozzle, said at least one jet-splitting system being configured for splitting said open jet of the coating medium from said one open-just nozzle into at least one coating jet flowing in a first direction toward said countersurface and at least one diversion jet flowing in a second direction substantially opposite to said first direction.

2. The applicator of claim 1, wherein said at least one jet-splitting system includes at least one jet-splitting surface configured for receiving and being impinged upon by substantially all of said open jet, said at least one jet-splitting surface being disposed at a predetermined impingement angle relative to said open jet, said at least one coating jet being disposed at a first angle relative to said open jet, said at least one diversion jet being disposed at a second angle relative to said open jet.

3. The applicator of claim 2, wherein said jet-splitting surface has a cross-sectional shape which is one of straight, convex, concave and double-concave.

4. the applicator of claim 2, wherein said jet-splitting surface has at least one of a predetermined surface structure and a surface coating.

5. The applicator of claim 2, further comprising at least one adjustment system connected to said at least one jet-splitting surface, said at least one adjustment system being configured to move said at least one jet splitting surface relative to at least one of said one open-jet nozzle and said at least one countersurface.

6. The applicator of claim 2, further comprising at least one adjustment system connected to said at least one jet-splitting surface, said at least one adjustment system being configured to at least one of rotate and Divot said at least one jet-splitting surface substantially across the web width relative to a flow direction of the open jet.

7. The applicator of claim 2, further comprising at least one adjustment system connected to said at least one jet-splitting surface, said at least one adjustment system being configured to at least one of zonewise rotate and pivot said at least one jet-splitting surface substantially across the web width relative to a flow direction of the open jet.

8. the applicator of claim 7, wherein said at least one jet-splitting surface is subdivided into zones across the web width.

9. An applicator for application of a coating medium onto a traveling fiber material web having a width, said applicator comprising:

at least one open-iet nozzle including an exit configured for issuing an open ket of the coating medium into the ambient atmosphere;

at least one countersurface disposed opposite said open-jet nozzle, at least one said countersurface being configured for one of backing the fiber web while the fiber web receives the coating medium from said at least one open-jet nozzle and transferring the coating medium from said at least one open-jet nozzle to the fiber web;

at least one jet-splitting system disposed between said exit of said one open-jet nozzle and said at least one countersurface, said at least one jet-splitting system being configured to be positioned in and disposed at a predetermined impingement angle relative to said open jet of the coating medium from said one open-jet nozzle, said at least one jet-splitting system being configured for splitting said open jet of the coating medium from said one open-jet nozzle into at least one coating jet flowing toward said countersurface and at least one diversion jet, said at least one coating jet being disposed at a first angle relative to said open jet, said at least one diversion jet being disposed at a second angle relative to said open jet, said at least one jet-splitting system including at least one jet-splitting surface configured for receiving said open jet;

at least one adjustment system connected to said at least one jet-splitting surface, said at least one adjustment system being configured to at least one of zonewise rotate, pivot and translators move said at least one jet-splitting surface substantially across the web width relative to a flow direction of the open jet; and at least one control system with a feedback control connected to said at least one adjustment system.

10. An applicator for application of a coating medium onto a traveling fiber material web having a width, said applicator comprising:

at least one open-jet nozzle including an exit configured for issuing an open jet of the coating medium into the ambient atmosphere;

at least one countersurface disposed opposite said open-jet nozzle, at least one said countersurface being configured for one of backing the fiber web while the fiber web receives the coating medium from said at least one open-jet nozzle and transferring the coating medium from said at least one open-jet nozzle to the fiber web;

at least one jet-splitting system disposed between said exit of said one open-jet nozzle and said at least one countersurface, said at least one jet-splitting system being configured to be positioned in said open jet of the coating medium from said one open-jet nozzle, said at least one jet-splitting system being configured for splitting said open jet of the coating medium from said one open-jet nozzle into at least one coating jet flowing toward said countersurface and at least one diversion jet; and at least one of a heating system and a cooling system associated with and configured for thermally compensating said jet splitting system.

11. A method of application of a coating medium onto a traveling countersurface, comprising the steps of:

issuing the coating medium in an open jet through an exit of an open-jet nozzle of an applicator, said open-jet nozzle being associated with the countersurface, said open jet extending through the ambient atmosphere;

directing substantially all of said open jet onto at least one jet-splitting system disposed between said exit of said open-jet nozzle and the countersurface;

splitting said open jet using said at least one jet-splitting system into at least one diversion jet having a first direction and at least one coating jet having a second direction substantially opposite to said first direction; and receiving said at least one coating jet onto the countersurface.

12. The method of claim 11, comprising the further steps of:

providing at least one jet-splitting surface on said at least one jet-splitting system; and one of rotating and pivoting said at least one jet-splitting surface, thereby adjusting at least one of a volume flow of said at least one coating jet, a mass flow of said at least one coating jet, a volume flow of said diversion jet, and a second impingement angle between said at least one coating jet and the countersurface.

13. The method of claim 11, wherein the countersurface comprises an applicator roll.

14. The method of claim 11, wherein the countersurface comprises a fiber material web.

15. A method of application of a coating medium onto a traveling countersurface, comprising the steps of:

issuing the coating medium in an open jet through an exit of all open-jet nozzle of an applicator, said open-jet nozzle being associated with the countersurface, said open jet extending through the ambient atmosphere;

directing said open jet onto at least one jet-splitting system disposed between said exit of said open-jet nozzle and the countersurface;

splitting said open jet using said at least one jet-splitting system into at least one diversion jet having a first direction and at least one coating jet having a second direction generally opposite to said first direction; receiving said at least one coating jet onto the countersurface;

collecting said at least one diversion jet; and returning said at least one diversion jet to said applicator with a coating medium circulation system.

* * * * *

UNITED STATES PATENT AND TRADEMARK OFFICE

CERTIFICATE OF CORRECTION

PATENT NO. : 5,914,155

DATED : June 22, 1999

INVENTOR(S) : Rudiger Kurtz

It is certified that error appears in the above-identified patent and that said Letters Patent is hereby corrected as shown below:

COLUMN 9

Line 1, claim 6, delete "Divot" and substitute --pivot-- therefor;

Line 17, claim 9, delete "Ket" and substitute --jet-- therefor; and

Line 44, claim 9, delete "translators" and substitute --translatory-- therefor.

Signed and Sealed this

Twenty-eighth Day of November, 2000

*Attest:*

*Attesting Officer*

Q. TODD DICKINSON

*Director of Patents and Trademarks*